US010584396B2

(12) United States Patent
Cho et al.

(10) Patent No.: US 10,584,396 B2
(45) Date of Patent: Mar. 10, 2020

(54) HEAT TREATABLE STEEL, PRODUCT FORMED THEREOF HAVING ULTRA HIGH STRENGTH AND EXCELLENT DURABILITY, AND METHOD FOR MANUFACTURING SAME

(71) Applicant: POSCO, Pohang-si, Gyeongsangbuk-do (KR)

(72) Inventors: Yeol-Rae Cho, Gwangyang-si (KR); Jae-Hoon Lee, Gwangyang-si (KR); Ki-Hyun Park, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 228 days.

(21) Appl. No.: 15/539,658

(22) PCT Filed: Dec. 22, 2015

(86) PCT No.: PCT/KR2015/014106

§ 371 (c)(1),
(2) Date: Jun. 23, 2017

(87) PCT Pub. No.: WO2016/105089

PCT Pub. Date: Jun. 30, 2016

(65) Prior Publication Data

US 2018/0002775 A1 Jan. 4, 2018

(30) Foreign Application Priority Data

Dec. 24, 2014 (KR) ..... 10-2014-0189131

(51) Int. Cl.

| | |
|---|---|
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C21D 8/02*** | (2006.01) |
| ***C21D 1/18*** | (2006.01) |
| ***C21D 8/04*** | (2006.01) |
| ***C21D 6/00*** | (2006.01) |
| ***C21D 8/10*** | (2006.01) |
| ***C21D 9/08*** | (2006.01) |
| ***C21D 9/48*** | (2006.01) |
| ***C22C 38/00*** | (2006.01) |

(Continued)

(52) U.S. Cl.

CPC ..... *C21D 9/46* (2013.01); *C21D 1/18* (2013.01); *C21D 6/002* (2013.01); *C21D 6/004* (2013.01); *C21D 6/005* (2013.01); *C21D 6/008* (2013.01); *C21D 8/0226* (2013.01); *C21D 8/0236* (2013.01); *C21D 8/0247* (2013.01); *C21D 8/0263* (2013.01); *C21D 8/0426* (2013.01); *C21D 8/0436* (2013.01); *C21D 8/0447* (2013.01); *C21D 8/105* (2013.01); *C21D 9/08* (2013.01); *C21D 9/085* (2013.01); *C21D 9/48* (2013.01); *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/26* (2013.01); *C22C 38/28* (2013.01); *C22C 38/32* (2013.01); *C22C 38/40* (2013.01); *C21D 1/00* (2013.01); *C21D 8/005* (2013.01); *C21D 8/0221* (2013.01); *C21D 2211/008* (2013.01)

(58) Field of Classification Search

CPC ..... C21D 1/00; C21D 6/002; C21D 8/0221; C21D 8/105; C22C 38/02; C22C 38/04; C22C 38/06; C22C 38/22; C22C 38/28

USPC ..... 148/334

See application file for complete search history.

(56) References Cited

U.S. PATENT DOCUMENTS 8,323,560 B2 * 12/2012 Satou ..... B23K 11/0873 420/90
2007/0130772 A1 * 6/2007 Sobe ..... C21D 9/42 29/897.2

(Continued)

FOREIGN PATENT DOCUMENTS

CN 103290339 A 9/2013
JP H11-050148 A 2/1999

(Continued)

OTHER PUBLICATIONS

Supplementary European Search Report for European Patent Application No. 15873616.5, dated Oct. 9, 2017.
International Search Report and Written Opinion issued in International Patent Application No. PCT/KR2015/014106, dated May 4, 2016; with partial English translation.
Japanese Office Action dated Oct. 2, 2018 issuyed in Japanese Patent Application No. 2017-533770.

(Continued)

*Primary Examiner* — Jie Yang
(74) *Attorney, Agent, or Firm* — Morgan, Lewis & Bockius LLP

(57) ABSTRACT

The present invention relates to a formed product used in vehicle components and the like, and to a method for manufacturing the same. The present invention provides heat treatable steel, a formed product using the same having ultra-high strength and excellent durability, and a method for manufacturing the same, wherein the heat treatable steel contains, in wt %, C (0.22-0.42%), Si (0.05-0.3%), Mn (1.0-1.5%), Al (0.01-0.1%), P (0.01% or less (including 0), S (0.005% or less), Mo (0.05-0.3%), Ti (0.01-0.1%), Cr (0.05-0.5%), B (0.0005-0.005%), N (0.01% or less), the balance Fe, and other inevitable impurities, Mn and Si satisfying Relationship formula (1), below, Mo/p satisfying Relationship formula (2), below: [Relationship formula 1] Mn/Si≥5 [Relationship formula 2] Mo/P≥15.

6 Claims, No Drawings

(51) Int. Cl.

| | |
|---|---|
| ***C22C 38/20*** | (2006.01) |
| ***C22C 38/26*** | (2006.01) |
| ***C22C 38/40*** | (2006.01) |
| *C21D 1/00* | (2006.01) |
| *C21D 8/00* | (2006.01) |

(56) References Cited

U.S. PATENT DOCUMENTS

| | | | | |
|---|---|---|---|---|
| 2007/0144632 | A1 | 6/2007 | Toyoda et al. | |
| 2008/0226491 | A1 | 9/2008 | Satou et al. | |
| 2009/0023506 | A1 | 1/2009 | Kondo et al. | |
| 2011/0091348 | A1 | 4/2011 | Hatano et al. | |
| 2013/0095347 | A1 | 4/2013 | Kawasaki et al. | |
| 2015/0053315 | A1 | 2/2015 | Matsumoto et al. | |
| 2019/0003004 | A1* | 1/2019 | Cho | C21D 6/002 |

FOREIGN PATENT DOCUMENTS

| | | | |
|---|---|---|---|
| JP | 2001-164338 | A | 6/2001 |
| JP | 2004-292930 | A | 10/2004 |
| JP | 2005-171337 | A | 6/2005 |
| JP | 2006-037205 | A | 2/2006 |
| JP | 2008-261049 | A | 10/2008 |
| JP | 2009-197253 | A | 9/2009 |
| JP | 2010-150612 | A | 7/2010 |
| JP | 2012-180594 | A | 9/2012 |
| JP | 2013-040390 | A | 2/2013 |
| JP | 2014-118613 | A | 6/2014 |
| KR | 10-2004-0057897 | A | 7/2004 |
| KR | 10-2008-0111549 | A | 12/2008 |
| KR | 10-2009-0124263 | A | 12/2009 |
| KR | 10-2011-0009252 | A | 1/2011 |
| KR | 10-2014-0016619 | A | 2/2014 |
| KR | 10-2014-0123111 | A | 10/2014 |
| WO | 2006/104023 | A1 | 10/2006 |
| WO | 2011/158818 | A1 | 12/2011 |

OTHER PUBLICATIONS

European Office Action dated Dec. 3, 2018 issued in European Patent Application No. 15873616.5.

Extended European Search Report dated Feb. 6, 2018 issued in European Patent Application No. 15873616.5.

* cited by examiner

HEAT TREATABLE STEEL, PRODUCT FORMED THEREOF HAVING ULTRA HIGH STRENGTH AND EXCELLENT DURABILITY, AND METHOD FOR MANUFACTURING SAME

TECHNICAL FIELD

The present disclosure relates to heat treatable steel for automotive components or the like, and, more particularly, to heat treatable steel, a product formed of the heat treatable steel and having ultra high strength and excellent durability, and a method for manufacturing the product.

BACKGROUND ART

Safety regulations for protecting vehicle passengers and fuel efficiency regulations for protecting the environment have recently been tightened, and thus there is increasing interest in techniques for improving the stiffness of automobiles and reducing the weight of automobiles.

For example, components such as stabilizer bars or tubular torsion beam axles of automotive chassis are required to have both stiffness and durability because they are used to support the weight of vehicles and are constantly subjected to fatigue loads during driving.

Moreover, the weight of vehicles has been gradually increased because of the recent increasing use of comfort components, and thus test conditions for guaranteeing durability have been tightened. Accordingly, the application of ultra high strength steels to heat treatable steel components has been increased for performance improvements and weight reduction.

The fatigue life of steel sheets for automotive components is closely related with the yield strength and elongation of the steel sheets, and the fatigue life of heat treatable steel sheets is affected by surface decarburization occurring during heat treatment processes or surface scratches formed during steel pipe manufacturing processes.

In particular, the influence of these factors increases in proportion to the strength of steel, and thus methods for manufacturing high strength automotive components having a tensile strength grade of 1500 MPa or greater, while solving problems arising during processes of forming ultra high strength steels, have been proposed.

Examples of such methods include a hot press forming method, in which high-temperature forming and die quenching are performed simultaneously, and a post heat treatment method in which cold forming, heating to an austenite region, and quenching by contact with a cooling medium instead of contact with a die, are performed sequentially. However, martensite obtained after quenching has low toughness even though it has high strength. Thus, to improve toughness, a method of performing a tempering process after a quenching process has been commonly used.

The degree of strength obtainable by the hot press forming method or the post heat treatment method is various, and a method of manufacturing automotive components having a tensile strength grade of 1500 MPa, using a heat treated-type steel pipe containing $22MnB_5$ or boron, was proposed in the early 2000 s.

Such automotive components are manufactured by producing an electric resistance welding (ERW) steel pipe using a hot-rolled or cold-rolled coil, cutting the ERW steel pipe in lengths, and heat treating the cut ERW steel pipe. That is, such automotive components are manufactured by producing an ERW steel pipe through a steel sheet slitting process, performing a solution treatment on the ERW steel pipe by heating the ERW steel pipe to an austenite region higher than or equal to $Ac_3$, and extracting the ERW steel pipe and hot forming the ERW steel pipe using a press equipped with a cooling device such that die quenching is performed simultaneously with the hot forming. In some cases, after the hot forming, hot-formed products may be taken out from a die and may then be quenched using a cooling medium.

In other methods, ultra high strength components having a strength of 1500 MPa or greater and martensite or a mixed phase of martensite and bainite as a final microstructure may be manufactured by cold forming a steel sheet in a shape similar to a component shape, performing a solution treatment on the cold-formed steel sheet by heating the cold-formed steel sheet to an austenite region higher than or equal to $Ac_3$, and extracting the heated steel sheet and quenching the heated steel sheet using a cooling medium, or such ultra high strength components may be manufactured by hot forming a steel sheet in a final product shape by using a die, and quenching the hot-formed steel sheet by bringing the hot-formed steel sheet into contact with a cooling medium.

In addition, a tempering process may be performed to increase the durability life and toughness of the components quenched, as described above.

In general, a tempering process is performed within a temperature range of 500° C. to 600° C. and, as a result of the tempering process, martensite transforms to ferrite, in which cementite is precipitated. Thus, although tensile strength decreases and a yield ratio increases to a range of 0.9 or greater, uniformity and total elongation are improved as compared to a quenched state.

As the weight of automobiles increases, there is an increasing need for higher-grade components made by heat treated-type steel pipes.

In a strengthening method, the content of manganese (Mn) and the content of chromium (Cr) in steel are fixed to a range of 1.2% to 1.4% and to a range of 0.1% to 0.3%, similar to the contents of Mn and Cr in heat treatable steel of the related art containing boron (B), and the content of carbon (C) in the steel is increased as a result of considering post-heat treatment strength of the steel. Based on the strengthening method, however, fatigue cracking and sensitivity to crack propagation increase because of an increase in strength, and thus the durability of steel, that is, the fatigue life of steel, is not increased in proportion to the increase in the strength of the steel.

DISCLOSURE

Technical Problem

An aspect of the present disclosure may provide heat treatable steel for manufacturing a formed product having ultra high strength and excellent durability.

An aspect of the present disclosure may also provide a formed product having ultra high strength and excellent durability.

An aspect of the present disclosure may also provide a method for manufacturing a formed product having ultra high strength and excellent durability.

Technical Solution

According to an aspect of the present disclosure, heat treatable steel may include, by wt %, carbon (C): 0.22% to 0.42%, silicon (Si): 0.05% to 0.3%, manganese (Mn): 1.0% to 1.5%, aluminum (Al): 0.01% to 0.1%, phosphorus (P):

0.01% or less (including 0%), sulfur (S): 0.005% or less, molybdenum (Mo): 0.05% to 0.3%, titanium (Ti): 0.01% to 0.1%, chromium (Cr): 0.05% to 0.5%, boron (B): 0.0005% to 0.005%, nitrogen (N): 0.01% or less, and a balance of iron (Fe) and inevitable impurities, wherein Mn and Si in the heat treatable steel may satisfy Formula 1, below, and Mo/P in the heat treatable steel may satisfy Formula 2, below:

$$Mn/Si \geq 5 \quad \text{[Formula 1]}$$

$$Mo/P \geq 15 \quad \text{[Formula 2]}$$

The heat treatable steel may further include at least one or two selected from the group consisting of niobium (Nb): 0.01% to 0.07%, copper (Cu): 0.05% to 1.0%, and nickel (Ni): 0.05% to 1.0%.

The heat treatable steel may have a microstructure including ferrite and pearlite, or a microstructure including ferrite, pearlite, and bainite.

The heat treatable steel may include one selected from the group consisting of a hot-rolled steel sheet, a pickled and oiled steel sheet, and a cold-rolled steel sheet.

The heat treatable steel may include a steel pipe.

According to another aspect of the present disclosure, a formed product having ultra high strength and excellent durability may include, by wt %, carbon (C): 0.22% to 0.42%, silicon (Si): 0.05% to 0.3%, manganese (Mn): 1.0% to 1.5%, aluminum (Al): 0.01% to 0.1%, phosphorus (P): 0.01% or less (including 0%), sulfur (S): 0.005% or less, molybdenum (Mo): 0.05% to 0.3%, titanium (Ti): 0.01% to 0.1%, chromium (Cr): 0.05% to 0.5%, boron (B): 0.0005% to 0.005%, nitrogen (N): 0.01% or less, and a balance of iron (Fe) and inevitable impurities, wherein Mn and Si in the formed product may satisfy Formula 1, below, Mo/P in the formed product may satisfy Formula 2, below, and the formed product may have a tempered martensite matrix, $$Mn/Si \geq 5 \quad \text{[Formula 1]}$$

$$Mo/P \geq 15 \quad \text{[Formula 2]}$$

According to another aspect of the present disclosure, a method for manufacturing a formed product having ultra high strength and excellent durability may include: preparing the heat treatable steel; forming the heat treatable steel to obtain a formed product; and tempering the formed product.

The forming of the heat treatable steel may be performed by heating the heat treatable steel and then hot forming and cooling the heat treatable steel simultaneously, using a cooling die.

The forming of the heat treatable steel may be performed by heating the heat treatable steel, hot forming the heat treatable steel, and cooling the heat treatable steel, using a cooling medium.

The forming of the heat treatable steel may be performed by cold forming the heat treatable steel, heating the heat treatable steel to an austenite temperature range and maintaining the heat treatable steel within the austenite temperature range, and cooling the heat treatable steel, using a cooling medium.

The above-described aspects of the present disclosure do not include all aspects or features of the present disclosure. Other aspects or features, and effects of the present disclosure, will be clearly understood from the following descriptions of exemplary embodiments.

Advantageous Effects

The present disclosure provides heat treatable steel for manufacturing a formed product having ultra high strength and excellent durability, and a product formed of the heat treatable steel and having ultra high strength and excellent durability. Thus, the heat treatable steel or the formed product may be used to manufacture heat treated-type components of automotive chassis or frames to reduce the weight of the components and improve the durability of the components.

BEST MODE

Embodiments of the present disclosure will now be described in detail.

In general, the tensile strength above 1500 MPa may be obtained by 22MnB5 steel. In order to get relatively high tensile strength, it is necessary to increase the carbon (C) content of steel. Boron-added heat treatable steel, for example, such as $25MnB_5$ or $34MnB_5$, may be used.

Boron-added heat treatable steel may include silicon (Si): 0.2% to 0.4%, manganese (Mn): 1.2% to 1.4%, phosphorus (P): 0.01% to 0.02%, and sulfur (S): less than 0.005%.

However, ultra high strength products formed of such boron-added heat treatable steel are affected by segregation of impurities such as P and S in proportion to the strength thereof, and if the microstructure of the ultra high strength products is not optimized after a tempering process, the durability of the ultra high strength products decreases.

Thus, the inventors have conducted research and experiments so as to improve the durability of ultra high strength products formed of boron-added heat treatable steel and, based on the results of the research and experiments, the inventors propose the present invention.

That is, according to the present disclosure, the composition of steel and manufacturing conditions therefor may be controlled to obtain a formed product having ultra high strength and excellent durability. In particular, 1) the content of phosphorus (P), deteriorating bendability or fatigue characteristics while segregating along austenite grain boundaries during a heat treatment process, is adjusted to be as low as possible, and the ratio of molybdenum (Mo)/phosphorus (P) is controlled, 2) the ratio of manganese (Mn)/silicon (Si) is controlled to suppress the formation of oxides in weld zones, and 3) tempering conditions are optimized to obtain excellent durability characteristics.

Hereinafter, steel for forming will be described in detail according to an aspect of the present disclosure.

According to an aspect of the present disclosure, heat treatable steel having improved fatigue characteristics includes, by wt %, carbon (C): 0.22% to 0.42%, silicon (Si): 0.05% to 0.3%, manganese (Mn): 1.0% to 1.5%, aluminum (Al): 0.01% to 0.1%, phosphorus (P): 0.01% or less (including 0%), sulfur (S): 0.005% or less, molybdenum (Mo): 0.05% to 0.3%, titanium (Ti): 0.01% to 0.1%, chromium (Cr): 0.05% to 0.5%, boron (B): 0.0005% to 0.005%, nitrogen (N): 0.01% or less, and the balance of iron (Fe) and inevitable impurities, wherein Mn and Si in the heat treatable steel satisfy Formula 1, below, and Mo/P in the heat treatable steel satisfies Formula 2, below:

$$Mn/Si \geq 5 \quad \text{[Formula 1]}$$

$$Mo/P \geq 15 \quad \text{[Formula 2]}$$

First, reasons for limiting the chemical composition of the heat treatable steel will be described according to the present disclosure.

Carbon (C): 0.22% to 0.42%

Carbon (C) is a key element for increasing the hardenability of steel sheets used for forming and, after steel sheets are die quenched or subjected to a quenching treatment, the strength of the steel sheets is markedly affected by the content of carbon (C). If the content of C is less than 0.22%, it may be difficult to obtain a strength of 1500 MPa or greater. If the content of C is greater than 0.42%, strength may increase excessively, and the possibility of stress concentration and cracking in weld zones increases in a process of manufacturing steel pipes for hot press forming. Therefore, the content of C may preferably be limited to 0.42% or less.

To obtain intended tensile strength after quenching and tempering, the content of C may be adjusted as follows: 0.23% to 0.27% for 1500 MPa grade, 0.33% to 0.37% for 1800 MPa grade, and 0.38% to 0.42% for 2000 MPa grade.

Silicon (Si): 0.05% to 0.3%

In addition to manganese (Mn), silicon (Si) is a key element determining the quality of weld zones of steel pipes for forming, rather than improving the hardenability of steel sheets for forming. As the content of Si increases, oxides may be more likely to remain in weld zones, and thus the process of flattening or expanding pipe may not be satisfactory. Although a lower Si content is more advantageous, the content of Si may be adjusted to be greater than or equal to 0.05%, which is the minimum amount of Si that may be contained as an impurity. However, if the content of Si is greater than 0.3%, the quality of weld zones may become unstable. Thus, preferably, the upper limit of the content of Si may be set to be 0.3%, and more preferably, the content of Si may be set to be within the range of 0.10% to 0.25%.

Mn: 1.0% to 1.5%

Like carbon (C), manganese (Mn) improves the hardenability of a steel sheet for forming and has the most decisive effect, next to C, on the strength of the steel sheet after the steel sheet is die quenched or subjected to a quenching treatment. However, when a steel pipe for forming is manufactured by an electric resistance welding (ERW) method, the welding quality of the steel pipe is dependent on the weight ratio of Si and Mn. If the content of Mn is low, the fluidity of molten materials in weld zones increases and thus oxides are easily removed, but post-heat treatment strength reduces. Thus, the lower limit of the content of Mn is set to be 1.0%. On the other hand, if the content of Mn is high, although strength increases, the fluidity of molten materials in weld zones decreases, and thus oxides are likely to remain in weld zones, lowering post-heat treatment bendability. Thus, preferably, the upper limit of the content of Mn may be set to be 1.5%, and more preferably, the content of Mn may be set to be within the range of 1.1% to 1.4%.

$$Mn/Si \geq 5.0 \qquad \text{Formula 1:}$$

When a steel pipe for forming is manufactured by an ERW method, the quality of the steel pipe is dependent on the content ratio of Mn and Si. If the content of Si increases and the content ratio of Mn/Si is less than 5, there is a high possibility that oxides may not be removed from weld zones but may remain in the weld zones, and in a flattening test after a steel pipe manufacturing process, the performance of a steel pipe may be low. Therefore, the content ratio of Mn/Si may be set to be 5.0 or greater.

Aluminum (Al): 0.01% to 0.1%

Aluminum (Al) is an element functioning as a deoxidizer. If the content of Al is less than 0.01%, the deoxidizing effect may be insufficient, and thus it may be preferable that the content of Al be 0.01% or greater. However, if Al is added excessively, Al forms a precipitate together with nitrogen (N) during a continuous casting process, thereby resulting in surface defects and excessive oxides remaining in weld zones when a steel pipe is manufactured by the ERW method. Therefore, it may be preferable that the content of Al be set to be 0.1% or less, and, more preferably, to 0.02% to 0.06%.

Phosphorus (P): 0.01% or less (including 0%)

Phosphorus (P) is an inevitably added impurity and has substantially no effect on strength after a forming process. However, P deteriorates bendability or fatigue characteristics because P precipitates along austenite grain boundaries during heating in a solution treatment before a forming process or during heating after a forming process. Thus, according to the present disclosure, the upper limit of the content of P may be set to be 0.01%, and preferably the content of P may be set to be within the range of 0.008% or less, and more preferably within the range of 0.006% or less.

Sulfur (S): 0.005% or less

Sulfur (S) is an impurity contained in the steel. If S combines with Mn in the form of elongated sulfides, cracks are easily formed along a metal flow inside a near weld region surface during a steel pipe manufacturing process, and S contained in a steel sheet deteriorates the toughness of the steel sheet after a cooling or quenching process. Thus, the content of S may preferably be set to be 0.005% or less. More preferably, the content of S may be set to be 0.003% or less, and, even more preferably, to 0.002% or less.

Molybdenum (Mo): 0.05% to 0.3%

In addition to chromium (Cr), molybdenum (Mo) improves the hardenability of a steel sheet and stabilizes the strength of the steel sheet after quenching. In addition, Mo is an effective element in widening an austenite temperature range to include a lower temperature and reducing segregation of P in steel during annealing in a hot or cold rolling process and during heating in a forming process.

If the content of Mo is less than 0.05%, the effect of improving hardenability or widening an austenite temperature range may not be obtained. Conversely, if the content of Mo is greater than 0.3%, even though strength is increased, it is not economical because the strength increasing effect is not high, compared to the amount of Mo used. Thus, the upper limit of the content of Mo may preferably be set to be 0.3%.

$Mo/P \geq 15.0$

The ratio of Mo/P has an effect on segregation of P along austenite grain boundaries when a steel pipe formed of the heat treatable steel is subjected to heating during a hot forming process or heating after a forming process.

Although it is important to reduce the content of P as an impurity, the addition of Mo has an effect of reducing segregation along grain boundaries.

To obtain this effect, the ratio of Mo/P may preferably be set to be 15.0 or greater. Although a higher ratio of Mo/P is more advantageous, the upper limit of the ratio of Mo/P is determined by considering both the above-described effect and economic aspects.

Titanium (Ti): 0.01% to 0.1%

During heating in a forming process or heating after a forming process, titanium (Ti) precipitates in the form of TiN, TiC, or TiMoC and suppresses the growth of austenite grains. In addition, if the precipitation of TiN occurs sufficiently in steel, the effectiveness of boron (B) in improving the hardenability of austenite is increased, and thus strength is stably improved after die quenching or a quenching treatment.

If the content of Ti in the heat treatable steel is less than 0.01%, the microstructure of the heat treatable steel is not sufficiently refined, or the strength of the heat treatable steel is not sufficiently improved. Conversely, if the content of Ti is greater than 0.1%, the effect of improvements in strength does not increase in proportion to the content of Ti. Thus, preferably, the upper limit of the content of Ti may be set to be 0.1%, and more preferably, the content of Ti may be set to be within the range of 0.02% to 0.06%.

Chromium (Cr): 0.05% to 0.5%

In addition to manganese (Mn) and carbon (C), chromium (Cr) improves the hardenability of a steel sheet for forming and increases the strength of the steel sheet after die quenching or a quenching treatment.

In a process of adjusting martensite, Cr has an effect on a critical cooling rate for easily obtaining martensite. Furthermore, in a hot press forming process, Cr lowers the $A_3$ temperature.

Preferably, Cr may be added in an amount of 0.05% or greater to obtain these effects. However, if the content of Cr is greater than 0.5%, hardenability required for a formed product assembly process may be increased excessively, and weldability may be decreased. Thus, the content of Cr may preferably be set to be 0.5% or less, and, more preferably, to 0.1% to 0.4%.

Boron (B): 0.0005% to 0.005%

Boron (B) is highly effective in improving the hardenability of a steel sheet for forming. Even a very small amount of B may markedly increase strength after die quenching or a quenching treatment.

If the content of B is less than 0.0005%, these effects may not be obtained, and thus it may be preferable that the content of B be 0.0005% or greater.

However, if the content of B is greater than 0.005%, the above-mentioned effects are saturated. Thus, the content of B may preferably be set to be 0.005% or less and, more preferably, to 0.001% to 0.004%.

Nitrogen (N): 0.01% or less

Nitrogen (N) is an inevitably added impurity facilitating the precipitation of AlN during a continuous casting process and causing cracks in corners of a continuously cast slab. However, it is known that N forms precipitates such as TiN and functions as a source of occlusion of diffusion hydrogen, and thus if the amount of N precipitation is properly controlled, resistance to hydrogen delayed fracture may be improved. Thus, preferably, the upper limit of the content of N may be set to be 0.01%, and more preferably, the content of N may be set to be within the range of 0.07% or less.

At least one or two selected from the group consisting of niobium (Nb): 0.01% to 0.07%, copper (Cu): 0.05% to 1.0%, and nickel (Ni): 0.05% to 1.0% may be added to the heat treatable steel having the above-described composition so as to improve the properties of the heat treatable steel.

Niobium (Nb): 0.01% to 0.07%

Niobium (Nb) is an element effective in grain refinement of steel.

Nb suppresses growth of austenite grains during heating in a hot rolling process and increases a non-crystallization temperature range in a hot rolling process, thereby markedly contributing to the refinement of a final microstructure.

In a later hot press forming process, such a refined microstructure has an effect of inducing grain refinement and effectively dispersing impurities such as P.

If the content of Nb is less than 0.01%, these effects may not be obtained, and thus it may be preferable that the content of Nb be 0.01% or greater.

However, if the content of Nb is greater than 0.07%, the sensitivity of a slab to cracks may increase in a continuous casting process, and the anisotropy of a hot-rolled or cold-rolled steel sheet may increase. Thus, the content of Nb may preferably be set to be 0.07% or less and, more preferably, to 0.02% to 0.05%.

Copper (Cu): 0.05% to 1.0%

Copper (Cu) is an element improving the corrosion resistance of steel. In addition, when a tempering process is performed to improve toughness after a forming process, supersaturated copper (Cu) leads to the precipitation of ε-carbide and thus age-hardening.

If the content of Cu is less than 0.05%, these effects may not be obtained, and thus the lower limit of the content of Cu may preferably be set to be 0.05%.

However, if the content of Cu is excessive, surface defects are caused during steel sheet manufacturing processes, and it is uneconomical because corrosion resistance does not increase as much as the amount of Cu. Thus, preferably, the upper limit of the content of Cu may be set to be 1.0%, and more preferably, the content of Cu may be set to be within the range of 0.2% to 0.8%.

Nickel (Ni): 0.05% to 1.0%

Nickel (Ni) is effective in improving the strength and toughness of a steel sheet for forming and the hardenability of the steel sheet, as well. In addition, Ni is effective in decreasing susceptibility to hot shortening caused when only copper (Cu) is added.

In addition, Ni widens an austenite temperature range to include a lower temperature and may thus effectively broaden a process window during annealing in a hot rolling process and a cold rolling process and during heating in a forming process.

If the content of Ni is less than 0.05%, these effects may not be obtained. Conversely, if the content of Ni is greater than 1.0%, although hardenability improves or strength increases, it is uneconomical because the effect of improving hardenability may not be proportional to the amount of Ni required. Thus, preferably, the upper limit of the content of Ni may be set to be 1.0%, and more preferably the content of Ni may be set to be within the range of 0.1% to 0.5%.

When the heat treatable steel is a raw material, that is, when the heat treatable steel is not heat treated, the heat treatable steel may have a microstructure including ferrite and pearlite or a microstructure including ferrite, pearlite, and bainite.

The heat treatable steel may be one selected from the group consisting of a hot-rolled steel sheet, a pickled and oiled steel sheet, and a cold-rolled steel sheet.

Alternatively, the heat treatable steel may be a steel pipe.

Hereinafter, a method for manufacturing a formed product using the heat treatable steel having improved fatigue characteristics will be described.

According to another aspect of the present disclosure, the method for manufacturing a formed product includes a process of preparing the heat treatable steel; a process of forming the heat treatable steel to obtain a formed product; and a process of tempering the formed product.

The heat treatable steel may be one selected from the group consisting of a hot-rolled steel sheet, a pickled and oiled steel sheet, and a cold-rolled steel sheet.

The process of forming the heat treatable steel to obtain a formed product may be performed as follows.

1) The process of forming the heat treatable steel to obtain a formed product may be performed by heating the heat treatable steel and then simultaneously hot forming and cooling the heat treatable steel using a cooling die.

For example, the hot forming may be hot press forming.

2) Alternatively, the process of forming the heat treatable steel to obtain a formed product may be performed by heating the heat treatable steel, hot forming the heat treatable steel, and cooling the hot formed, heat treatable steel using a cooling medium.

For example, the hot forming may be hot press forming.

For example, the cooling using a cooling medium may be water cooling or oil cooling.

After heating the heat treatable steel to an austenite temperature range and extracting and hot forming the heat treatable steel, the heat treatable steel may be water cooled or oil cooled. Here, if the heat treatable steel is cooled in the hot forming process, the heat treatable steel may be reheated and then water cooled or oil cooled.

3) Alternatively, the process of forming the heat treatable steel to obtain a formed product may be performed by cold forming the heat treatable steel, heating the heat treatable steel to an austenite temperature range and maintaining the heat treatable steel within the austenite temperature range, and cooling the heat treatable steel, using a cooling medium.

For example, the cold forming may be cold press forming.

For example, the cooling using a cooling medium may be water cooling or oil cooling.

The formed product obtained by cold forming the heat treatable steel may be heated to an austenite temperature range and maintained within the austenite temperature range, and then the formed product may be extracted and water cooled or oil cooled.

In the method of simultaneously performing hot forming and cooling using a die, and the method of performing hot forming and then cooling using a cooling medium the heat treatable steel may be heated to a temperature range of 850° C. to 950° C. and maintained within the temperature range for 100 seconds to 1,000 seconds, for example.

In the method of simultaneously performing hot forming and cooling, the heat treatable steel heated and maintained as described above may be extracted, hot formed using a prepared die, and cooled directly in the die to 200° C. or less, at a cooling rate ranging from a critical cooling rate of martensite to 300° C./s, for example.

In the method of performing hot forming and then cooling using a cooling medium, the heat treatable steel heated and maintained as described above may be extracted, hot formed, and water or oil cooled to 200° C. or lower, at a cooling rate ranging from a critical cooling rate of martensite to 300° C./s, for example.

In the method of performing cold forming and then a heat treatment, the formed product may be heated to a temperature of 850° C. to 950° C. in a high frequency induction heating furnace or in a batch heating furnace and may be maintained at the temperature for 100 seconds to 1,000 seconds, for example. Then, the formed products may be cooled using a proper cooling medium to 200° C. or less at a cooling ratio ranging from a critical cooling rate of martensite to 300° C./s.

If the heating temperature is less than 850° C., ferrite transformation may proceed from the surface of the heat treatable steel because of a temperature decrease while the heat treatable steel is being extracted from a heating furnace and hot formed, and thus martensite may not be sufficiently formed across the thickness of the heat treatable steel, making it difficult to obtain an intended degree of strength.

Conversely, if the heating temperature is greater than 950° C., austenite grains may coarsen, manufacturing costs may increase because of heating costs, and durability may deteriorate after a final heat treatment because of accelerated surface decarbonization.

Therefore, it may be preferable that the heating temperature of the heat treatable steel be within the range of 850° C. to 950° C.

The cooling rate after the hot forming may be set to obtain a final microstructure having a martensite matrix. To this end, the cooling rate may be set to be higher than a critical cooling rate of martensite. That is, the lower limit of the cooling rate may be set to be the critical cooling rate of martensite.

However, if the cooling rate is excessively high, the effect of strengthening is saturated, and additional cooling equipment may be required. Thus, the upper limit of the cooling rate may preferably be set to be 300° C./s.

If the cooling temperature is greater than 200° C., martensite transformation may not completely occur, and thus an intended martensite structure may not be obtained. As a result, it may be difficult to obtain an intended degree of strength.

Next in this process, the formed product manufactured as described above is tempered.

The formed product having a martensite matrix is tempered to impart toughness to the formed product and to determine the durability of the formed product according to tempering conditions.

A key factor of tempering conditions is a tempering temperature.

The inventors have observed variations in elongation with respect to the tempering temperature and found that elongation increases in proportion to the tempering temperature up to a certain point, and then elongation decreases, even though the tempering temperature increases.

The inventors found that if tempering is performed at a temperature (Ttempering) at which elongation has a peak, the durability life of the formed product increases markedly, and found that the Ttempering has a relationship with the content of C, as expressed by Formula 3, below:

$$\text{Ttempering } (^\circ\text{ C.}) = 111 * [C]^{-0.633} \quad \text{[Formula 3]}$$

According to the present disclosure, the formed product manufactured as described above is tempered by maintaining the formed product at a tempering temperature satisfying the following Formula 4 for 15 minutes to 60 minutes.

$$\text{Tempering temperature } (^\circ\text{ C.}) = \text{Ttempering } (^\circ\text{ C.}) \pm 30 \quad [\text{where Ttempering } (^\circ\text{ C.}) = 111 * [C]^{-0.633}] \quad \text{[Formula 4]}$$

As described above, the formed product is tempered to improve the toughness and durability of the formed product.

After the tempering, the formed product may have a tempered martensite single phase microstructure or a microstructure including tempered martensite in an amount of 90% or more and at least one or two from the group consisting of ferrite, bainite, and retained austenite as a remainder.

The formed product manufactured as described above may have a tensile strength of 1500 MPa or greater.

For example, the formed product may have a tensile strength of 1600 MPa or greater.

The formed product may have a yield ratio of 0.7 to 0.9.

In general, a martensite matrix obtained through a quenching process has a high degree of tensile strength but a low degree of elongation, and a yield ratio of 0.7 or less. If tempering is performed under conventional tempering conditions, that is, at a temperature of 500° C. to 600° C., yield strength and tensile strength decrease markedly, elongation is increased, and a yield ratio of 0.9 or higher is obtained.

Thus, the inventors have evaluated tensile strength characteristics and low-frequency fatigue characteristics while varying the temperature of a tempering process performed after a quenching process and have found an interesting phenomenon.

That is, as the temperature of a tempering process increases, yield strength increases and peaks at a temperature of 200° C. to 300° C. Then, with a further increase of the tempering temperature, yield strength decreases linearly and constantly, and with the increase of the tempering temperature, tensile strength decreases constantly. Elongation, particularly uniform elongation, decreases markedly when the tempering temperature is 250° C. or greater, and then increases when the tempering temperature is 400° C. or greater.

In terms of microstructure, C dissolved in martensite by a quenching process undergoes a change of state when a tempering process is performed. If the temperature of the tempering process is low, ε-carbide exists. However, if the temperature of the tempering process is high, ε-carbide converts to cementite, and this precipitation of cementite explains why yield strength and tensile strength decrease.

A low-frequency fatigue test ($\Delta\varepsilon/2=\pm0.5\%$) was performed while controlling stain, with respect to a tempering temperature, so as to evaluate fatigue life. According to the test, fatigue life increased and peaked in a tempering temperature range of 200° C. to 250° C., and when the tempering temperature was higher than this range, fatigue life decreased. In other words, it can be found that low-frequency fatigue life increases markedly if yield strength is increased and a yield ratio of 0.7 to 0.9 is obtained without a decrease in elongation, particularly uniform elongation, as a result of a tempering process performed after a quenching process.

The formed product has a long fatigue life.

The formed product has a low-frequency fatigue life preferably within the range of 5,000 cycles or more (where the number of cycles refers to a cycle number at which fracture occurs under a strain application condition of $\Delta\varepsilon/2=\pm0.5\%$).

Hereinafter, an example method for manufacturing heat treatable steel as a starting material for forming a formed product will be described according to the present disclosure.

The heat treatable steel may be at least one selected from the group consisting of a hot-rolled steel sheet, a pickled and oiled steel sheet, and a cold-rolled steel sheet, and example methods for manufacturing such steel sheets will now be described according to the present disclosure.

A hot-rolled steel sheet may be manufactured through the following processes:

heating a steel slab having the same composition as the composition of the heat treatable steel of the present disclosure to a temperature range of 1150° C. to 1300° C.;

manufacturing a steel sheet by rough rolling and hot rolling the heated steel slab; and coiling the steel sheet at a temperature of 500° C. to 700° C.

Since the steel slab is heated to a temperature range of 1150° C. to 1300° C., the microstructure of the steel slab may become homogenized, and even though some of the carbonitride precipitates, such as Nb and Ti precipitates, are dissolved, growth of grains of the steel slab may be suppressed, thereby preventing the excessive growth of grains.

The hot rolling may include finish hot rolling at a temperature of $Ar_3$ or greater.

If the temperature of finish hot rolling is lower than $Ar_3$, some austenite may be transformed into ferrite, to result in a dual phase region (in which ferrite and austenite exist together), and hot rolling may be performed in this state. In this case, resistance to deformation is not uniform, and thus the mass flow of the steel slab may be negatively affected. In addition, if stress concentrates on ferrite, slab fracture may occur.

Conversely, if the temperature of finish hot rolling is excessively high, surface defects such as sand-like scale may be formed. Thus, the temperature of hot finish rolling may preferably be set to be 950° C. or less.

In addition, when the steel sheet is cooled and coiled using a run-out table after the hot rolling, the coiling temperature may be adjusted so as to reduce width-wise material property variations of the steel sheet and prevent the formation of a low-temperature phase such as martensite, which may have a negative influence on the mass flow of the steel sheet in a subsequent cold rolling process.

If the coiling temperature is lower than 500° C., a low-temperature microstructure such as martensite may be formed, and thus the strength of the steel sheet may be increased excessively. Particularly if the steel sheet is overcooled in a width direction of a coil, material properties of the steel sheet may be varied in the width direction, and the mass flow of the steel sheet may be negatively affected in a subsequent cold rolling process, thereby making it difficult to control the thickness of the steel sheet.

Conversely, if the coiling temperature is greater than 700° C., internal oxidation may occur in the surface of the steel sheet, and thus cracks that are formed as internal oxides are removed in a pickling process may develop as notches. As a result, it may be difficult to flatten or expand a final product such as a steel pipe. Thus, the upper limit of the coiling temperature may preferably be limited to 700° C.

The steel sheet formed by hot rolling may be cold rolled to form a cold-rolled steel sheet. In this case, the cold rolling is not limited to particular conditions or methods, and the reduction ratio of the cold rolling may be within the range of 40% to 70%.

According to an example method of forming a cold-rolled steel sheet, the hot-rolled steel sheet manufactured by the above-described method of the present disclosure is pickled to remove surface oxides and is cold rolled to form a cold-rolled steel sheet, and the cold-rolled steel sheet (fully hardened material) is continuously annealed.

The temperature of the annealing may range from 750° C. to 850° C.

If the annealing temperature is lower than 750° C., recrystallization may occur insufficiently, and if the annealing temperature is higher than 850° C., grain coarsening may occur and costs for annealing may increase.

After the annealing, overaging may be performed within the temperature range of 400° C. to 600° C. to obtain a ferrite matrix in which pearlite or bainite is partially included.

In this case, the cold-rolled steel sheet may have a strength of 800 MPa or less, similar to the hot-rolled steel sheet.

Furthermore, in the present disclosure, a steel pipe being used as a starting material for manufacturing a formed product may be manufactured by any method without limitations.

The steel pipe may be manufactured using the above-described steel sheet of the present disclosure by an ERW method. In this case, ERW conditions are not limited.

A drawing process may be performed to reduce the diameter of the steel pipe or to ensure the straightness of the steel pipe. Before the drawing process, it may be necessary to pretreat the steel pipe by heating the steel pipe to a temperature range of 500° C. to $Ac_1$ and cooling the steel pipe in air, so as to reduce the hardness of weld zones formed after ERW, and form a microstructure suitable for drawing. If the drawing ratio, that is, the difference between the initial outer diameter and the final outer diameter expressed in a percentage, is greater than 40%, drawing defects may be formed because of excessive deformation. Thus, it may be preferable that the drawing ratio be set to be within the range of 10% to 35%.

[Mode for Invention]

Hereinafter, the present disclosure will be described more specifically according to examples.

However, the following examples should be considered in a descriptive sense only and not for purposes of limitation. The scope of the present invention is defined by the appended claims, and modifications and variations may be reasonably made therefrom.

EXAMPLE 1

Steel slabs having compositions shown in Table 1, below, were hot rolled to obtain hot-rolled steel sheets, and the hot-rolled steel sheets were pickled and oiled.

The hot rolling was performed on the steel slabs to obtain hot-rolled steel sheets having a thickness of 4.5 mm by heating the steel slabs within the temperature range of 1200° C.±30° C. for 180 minutes to homogenize the steel slabs, performing rough rolling and finish rolling on the steel slabs to obtain hot-rolled steel sheets, and coiling the hot-rolled steel sheets at temperatures shown in Table 2, below.

Steel pipes having an outer diameter of 28 mm were produced using the picked hot-rolled steel sheets by an electric resistance welding (ERW) method.

The quality of weld zones of the steel pipes was evaluated by a flattening test in which the weld lines of the steel pipes were aligned in a 3 o'clock direction, and cracking in the weld zones of the steel pipes was checked after compressing the steel pipes. Results of the flattening test are shown in Table 2, below. In Table 2, "O" denotes no cracking, and "X" denotes cracking in welding zones.

New specimens (steel sheets) were prepared under conditions allowing the steel sheets to pass the flattening test. Then, JIS 5 tensile test specimens (parallel portion width 25 mm, gauge length 25 mm), and low-frequency fatigue test specimens (parallel portion width 12.5 mm, gauge length mm) were taken from the new specimens in a direction parallel to the rolling direction of the new specimens.

The specimens were maintained at 900° C. for 7 minutes and quenched in a water bath while maintaining the temperature of the water bath at 20° C.

The quenched specimens were heat treated within a temperature range of 200° C. to 330° C. for one hour, according to C contents thereof, as shown in Table 2, below, and then tensile characteristics and fatigue characteristics of the specimens were evaluated. Fatigue life was evaluated by applying a stain of $\Delta\varepsilon/2=\pm0.5\%$ in a triangular wave form at a deformation frequency of 0.2 Hz.

In addition, Table 2, below, shows tensile characteristics of the hot-rolled steel sheets.

In Table 2, YS, TS, and El refer to yield strength, tensile strength, and elongation, respectively, and fatigue life refers to the number of cycles at which fracture occurred under a strain application condition of $\Delta\varepsilon/2=\pm0.5\%$.

TABLE 1

| | | Chemical composition (wt %) | | | | | | | | | | | | | | |
|---|---|---|---|---|---|---|---|---|---|---|---|---|---|---|---|---|
| No | Products | C | Si | Mn | P | S | s-Al | Ti | Cr | B* | Mo | **AE | N* | Mn/Si | Mo/P | Steels |
| 1 | *PO | 0.34 | 0.20 | 1.29 | 0.013 | 0.0025 | 0.025 | 0.03 | 0.15 | | 0.15 | — | 42 | 6.5 | 11.5 | ***CS |
| 2 | PO | 0.35 | 0.15 | 1.3 | 0.0071 | 0.0027 | 0.029 | 0.029 | 0.16 | 20 | 0.14 | — | 45 | 8.7 | 19.7 | ****IS |
| 3 | PO | 0.35 | 0.15 | 1.3 | 0.0070 | 0.0027 | 0.031 | 0.025 | 0.17 | 19 | 0.15 | Nb: 0.05 | 42 | 8.7 | 21.4 | IS |
| 4 | PO | 0.26 | 0.25 | 1.1 | 0.0058 | 0.0012 | 0.03 | 0.033 | 0.4 | 22 | 0.1 | — | 41 | 4.4 | 17.2 | CS |
| 5 | PO | 0.25 | 0.15 | 1.25 | 0.0058 | 0.0012 | 0.03 | 0.033 | 0.4 | 22 | 0.1 | — | 50 | 8.3 | 17.2 | IS |
| 6 | PO | 0.35 | 0.20 | 1.4 | 0.0071 | 0.0025 | 0.025 | 0.023 | 0.17 | 19 | 0.15 | Cu: 0.2 | 38 | 7.0 | 21.1 | IS |
| 7 | PO | 0.35 | 0.21 | 1.3 | 0.0066 | 0.0021 | 0.023 | 0.03 | 0.18 | 18 | 0.19 | Cu: 0.5<br>Ni: 0.3 | 55 | 6.2 | 28.8 | IS |
| 8 | PO | 0.20 | 0.11 | 1.3 | 0.008 | 0.0015 | 0.031 | 0.029 | 0.4 | 26 | 0.21 | — | 57 | 11.8 | 26.3 | IS |
| 9 | PO | 0.35 | 0.25 | 1.2 | 0.013 | 0.0011 | 0.029 | 0.032 | 0.38 | 25 | 0.2 | — | 60 | 4.8 | 15.4 | CS |
| 10 | PO | 0.4 | 0.16 | 1.3 | 0.0078 | 0.0009 | 0.027 | 0.029 | 0.15 | 17 | 0.18 | — | 38 | 8.1 | 23.1 | IS |
| 11 | PO | 0.35 | 0.30 | 1.2 | 0.015 | 0.0011 | 0.029 | 0.032 | 0.38 | 25 | 0.1 | — | 40 | 4.0 | 6.7 | CS |
| 12 | PO | 0.35 | 0.40 | 1 | 0.0082 | 0.0023 | 0.025 | 0.023 | 0.17 | 24 | 0.25 | — | 45 | 2.5 | 30.5 | CS |

*PO: pickled and oiled steel sheet,
**AE: Additional Elements,
***CS: Comparative Steel,
****IS: Inventive Steel
(In Table 1 above, the contents of B and N are in ppm)

TABLE 2

| | | Tensile characteristics of starting materials | | | | | Tensile characteristics after tempering | | | | Yield | Fatigue | |
|---|---|---|---|---|---|---|---|---|---|---|---|---|---|
| No | Products | Coiling (° C.) | YS (Mpa) | TS (Mpa) | El (%) | ** FT | Tempering (° C.) | YS (Mpa) | TS (Mpa) | El (%) | Ratio (YR) | Life (cycles) | Steels |
| 1 | *PO | 650 | 442 | 640 | 23 | ○ | 220 | 1450 | 1807 | 9.9 | 0.802 | 5540 | ***CS |
| 2 | PO | 650 | 428 | 620 | 22 | ○ | 220 | 1460 | 1800 | 10.1 | 0.811 | 6445 | ****IS |
| 3 | CR | 600 | 477 | 658 | 20 | ○ | 220 | 1490 | 1820 | 11.0 | 0.819 | 6910 | IS |
| 4 | PO | 650 | 400 | 567 | 26 | X | — | 1310 | 1640 | 12 | 0.799 | — | CS |
| 5 | PO | 680 | 410 | 570 | 27 | ○ | 250 | 1270 | 1605 | 11.6 | 0.791 | 6320 | IS |
| 6 | PO | 650 | 454 | 655 | 23 | ○ | 220 | 1445 | 1840 | 9.5 | 0.785 | 6700 | IS |
| 7 | PO | 650 | 448 | 637 | 24 | ○ | 220 | 1455 | 1820 | 9.9 | 0.799 | 6819 | IS |
| 8 | PO | 650 | 387 | 520 | 28 | ○ | 330 | 1050 | 1430 | 13 | 0.734 | 6510 | CS |
| 9 | PO | 650 | 431 | 620 | 22 | X | 220 | 1450 | 1803 | 10 | 0.804 | — | CS |
| 10 | PO | 650 | 472 | 688 | 20 | ○ | 200 | 1654 | 2070 | 8.8 | 0.799 | 6990 | IS |
| 11 | PO | 650 | 442 | 620 | 22 | X | 220 | 1438 | 1817 | 10.5 | 0.791 | 5020 | CS |
| 12 | PO | 650 | 415 | 614 | 24 | X | 220 | 1430 | 1801 | 10.7 | 0.794 | — | CS |

*PO: pickled and oiled steel sheet,
** FT: Flattening Test,
***CS: Comparative Steel,
****IS: Inventive Steel As shown in Tables 1 and 2, above, tensile strength was measured after tempering was performed in a range of 1430 MPa to 2070 MPa, depending mainly on the content of C.

Specimen 8, having a low C content, has a low post-tempering tensile strength, at the level of 1430 MPa, and Specimen 10, having a C content of 0.4%, has a high post-tempering tensile strength, at the level of 2070 MPa.

Specimens 4, 9, 11, and 12, having a high Si content and a Mn/Si ratio of 5 or less, had cracks in the steel pipe flattening test. However, the other specimens, having a satisfactory Mn/Si ratio even though having a high C content, did not have cracks in weld zones.

As described above, if tempering is performed after quenching, a tensile strength of 1500 MPa or greater is obtained. However, Specimen 8 has a tensile strength of 1500 MPa or less because of a high C content. As shown in Tables 1 and 2, low-frequency fatigue lives measured after tempering were different according to Mo/P ratios. That is, Specimens 1 and 11, having a low Mo/P ratio, had a fatigue life of less than 5500 cycles, for example. However, specimens having a Mo/P ratio of 15 or greater had a fatigue life of 6,000 cycles or greater.

EXAMPLE 2

Steel slabs, having compositions shown in Table 3, below, were hot rolled to obtain hot-rolled steel sheets, and the hot-rolled steel sheets were pickled and oiled.

The hot rolling was performed on the steel slabs to obtain hot-rolled steel sheets having a thickness of 3.0 mm by heating the steel slabs within the temperature range of 1200° C.±20° C. for 180 minutes to homogenize the steel slabs, performing rough rolling and finish rolling on the steel slabs to obtain hot-rolled steel sheets, and coiling the hot-rolled steel sheets at temperatures shown in Table 4, below.

In Table 3, below, Ttempering (° C.) refers to a temperature calculated by Formula 3, below.

$$\text{Ttempering (° C.)} = 111*[C]^{-0.633} \quad \text{[Formula 3]}$$

The pickled and oiled hot-rolled steel sheets were quenched and tempered.

The hot-rolled steel sheets were heated at 930° C. for 6 minutes and then quenched in a water bath, while maintaining the temperature of the water bath at 20° C.

The tempering was performed at a temperature of 200° C. to 500° C. for 30 minutes to 60 minutes, and then tensile characteristics and fatigue life characteristics were evaluated. Results of the evaluation are shown in Table 4, below. Here, the tensile characteristics and fatigue life characteristics were evaluated in the same manner as in Example 1.

In addition, Table 4, below, shows tensile characteristics of the hot-rolled steel sheets.

In Table 4, YS, TS, and El refer to yield strength, tensile strength, and elongation, respectively, and fatigue life refers to the number of cycles at which fracture occurred under a strain application condition of $\Delta\varepsilon/2=\pm0.5\%$.

TABLE 3

| | | Chemical Composition (wt %) | | | | | | | | | | | | | Ttempering |
|---|---|---|---|---|---|---|---|---|---|---|---|---|---|---|---|
| No | Products | C | Si | Mn | P | S | s-Al | Ti | Cr | B* | Mo | N* | Mn/Si | Mo/P | (° C.) |
| 2 | *PO | 0.35 | 0.15 | 1.3 | 0.0071 | 0.0027 | 0.029 | 0.029 | 0.16 | 20 | 0.14 | 45 | 8.7 | 19.7 | 215.7 |
| 5 | PO | 0.25 | 0.15 | 1.25 | 0.0058 | 0.0012 | 0.03 | 0.033 | 0.4 | 22 | 0.1 | 50 | 8.3 | 17.2 | 266.9 |
| 10 | PO | 0.4 | 0.16 | 1.3 | 0.0078 | 0.0009 | 0.027 | 0.029 | 0.15 | 17 | 0.18 | 38 | 8.1 | 23.1 | 198.3 |

*PO: pickled and oiled steel sheet (In Table 3 above, the contents of B and N are in ppm)

TABLE 4

| | | Tensile characteristics of starting materials | | | | Tensile characteristics after tempering | | | | Yield | Low-frequency fatigue | |
|---|---|---|---|---|---|---|---|---|---|---|---|---|
| No | Products | Coiling (° C.) | YS (Mpa) | TS (Mpa) | El (%) | Tempering (° C.) | YS (Mpa) | TS (Mpa) | El (%) | ratio (YR) | life (cycles) | Notes |
| 2-0 | *PO | 650 | 428 | 620 | 22 | Quenching | 1186 | 1951 | 6.6 | 0.608 | 4560 | — |
| 2-1 | PO | 650 | 428 | 620 | 22 | 220 | 1460 | 1800 | 10.1 | 0.811 | 6445 | **IR |
| 2-2 | PO | 650 | 428 | 620 | 22 | 240 | 1428 | 1643 | 8.0 | 0.869 | 5690 | IR |
| 2-3 | PO | 650 | 428 | 620 | 22 | 330 | 1370 | 1500 | 9.0 | 0.913 | 3300 | — |
| 2-4 | PO | 650 | 428 | 620 | 22 | 500 | 1034 | 1100 | 13.0 | 0.94 | 3580 | — |
| 5-0 | PO | 680 | 410 | 570 | 27 | Quenching | 1018 | 1670 | 6.9 | 0.610 | 4250 | — |
| 5-1 | PO | 680 | 410 | 570 | 27 | 250 | 1270 | 1605 | 11.6 | 0.791 | 6320 | IR |
| 5-2 | PO | 680 | 410 | 570 | 27 | 330 | 1190 | 1310 | 9.7 | 0.908 | 4310 | — |
| 10-0 | PO | 650 | 472 | 688 | 20 | Quenching | 1302 | 2160 | 5.9 | 0.603 | 4900 | — |
| 10-1 | PO | 650 | 472 | 688 | 20 | 200 | 1650 | 2070 | 8.8 | 0.797 | 6990 | IR |
| 10-2 | PO | 650 | 472 | 688 | 20 | 330 | 1600 | 1700 | 7.5 | 0.941 | 4705 | — |

*PO: pickled and oiled steel sheet,

**IR: Inventive Range

In Table 4, above, No. 2-0, 5-0, and 10-0 refer to specimens that were heated at 930° C. for 6 minutes and quenched in a water bath having a temperature of 20° C. but were not tempered. As shown in Table 4, Specimens 2-0, 5-0, and 10-0 have a yield ratio close to 0.6 and a relatively low fatigue life, compared to the case in which tempering was performed at 200° C., 220° C., 240° C., and 250° C.

In addition, as shown in Tables 3 and 4, when a heat treatment was performed in a tempering temperature range satisfying Formula 4, below, high yield strength was obtained, and a long fatigue life was obtained in the case of the yield ratio being within the range of 0.7 to 0.9.

Tempering temperature (° C.)=Ttempering (° C.)±30° C. [where Ttempering (° C.)= $111*[C]^{-0.633}$] [Formula 4]

When tempering was performed under conditions not satisfying Formula 4, fatigue lives were 5,000 cycles or less. In particular, Specimens 2-3 and 2-4 had a fatigue life of 5,000 cycles or less, despite having high elongation.

The invention claimed is:

1. A method for manufacturing a formed product having tensile-strength of 1500MPa or more and a frequency fatigue life of 5,000 cycles or more, where a number of cycles refers to a cycle number at which fracture occurs under a ± 0.5% strain application condition, the method comprising:

preparing heat treatable steel, the heat treatable steel comprising, by wt %, carbon (C): 0.22% to 0.42%, silicon (Si): 0.05% to 0.3%, manganese (Mn): 1.0% to 1.5%, aluminum (Al): 0.01% to 0.1%, phosphorus (P): 0.01% or less(including 0%), sulfur (S): 0.005% or less, molybdenum (Mo): 0.05% to 0.3%, titanium (Ti): 0.01% to 0.1%, chromium (Cr): 0.05% to 0.5%, boron (B): 0.0005% to 0.005%, nitrogen (N): 0.01% or less, and a balance of iron (Fe) and inevitable impurities, wherein Mn and Si in the heat treatable steel satisfy Formula 1, below, and Mo/P in the heat treatable steel satisfies Formula 2, below, Mn/Si ≥5 [Formula 1]

Mo/P ≥15; [Formula 2]

forming the heat treatable steel to obtain a formed product;

wherein the forming of the heat treatable steel is performed by heating the heat treatable steel and then hot forming and cooling the heat treatable steel simultaneously, using a cooling die, in the heating of the heat treatable steel before the hot forming of the heat treatable steel, the heat treatable steel is heated to a temperature of 850° C. to 950° C. and maintained at the temperature for 100 seconds to 1,000 seconds, and in the cooling of the heat treatable steel after the hot forming of the heat treatable steel, the heat treatable steel is cooled to a temperature of 200° C. or less at a cooling rate ranging from a critical cooling rate of martensite to 300° C./s; and tempering the formed product, wherein the tempering of the formed product is performed by maintaining the formed product at a tempering temperature satisfying Formula 4, below, for 15 minutes to 60 minutes, Tempering temperature(° C.)=Ttempering(° C.)±30° C.[where Ttempering (° C.)=$111*[C.]^{-0.633}$] [Formula 4].

2. The method of claim 1, wherein the heat treatable steel further comprises at least one or two selected from the group consisting of niobium (Nb): 0.01% to 0.07%, copper (Cu): 0.05% to 1.0%, and nickel (Ni): 0.05% to 1.0%.

3. The method of claim 1, wherein the heat treatable steel comprises one selected from the group consisting of a hot-rolled steel sheet, a pickled and oiled steel sheet, and a cold-rolled steel sheet.

4. The method of claim 1, wherein the heat treatable steel comprises a steel pipe.

5. The method of claim 1, wherein a content of carbon in the heat treatable steel is adjusted 0.23% to 0.27% for 1500 MPa grade, 0.33% to 0.37% for 1800 MPa grade, and 0.38% to 0.42% for 2000 MPa grade.

6. The method of claim 1, wherein the heat treatable steel further comprises niobium (Nb) in an amount of 0.01% to 0.07%.

* * * * *